US005465739A

United States Patent [19]

Perfetti et al.

[11] Patent Number: 5,465,739

[45] Date of Patent: Nov. 14, 1995

[54] CIGARETTE AND CIGARETTE FILTER ELEMENT THEREFOR

[75] Inventors: Thomas A. Perfetti; Dennis L. Carespodi, both of Winston-Salem; Barry L. Saintsing, Lexington; Matthew S. Koschak, Pfafftown, all of N.C.

[73] Assignee: R. J. Reynolds Tobacco Company, Winston-Salem, N.C.

[21] Appl. No.: 945,042

[22] Filed: Sep. 15, 1992

Related U.S. Application Data

[63] Continuation-in-part of Ser. No. 868,925, Apr. 15, 1992, abandoned.

[51] Int. Cl.[6] ..... A24D 3/00

[52] U.S. Cl. ..... 131/335; 131/332

[58] Field of Search ..... 131/332, 335, 131/341

[56] References Cited

U.S. PATENT DOCUMENTS

| | | | |
|---|---|---|---|
| 2,928,400 | 3/1960 | Touey . | |
| 3,368,566 | 2/1968 | Avedikian | 131/344 X |
| 3,620,227 | 11/1971 | Saito | 131/332 X |
| 4,521,493 | 6/1985 | Class | 131/340 X |

OTHER PUBLICATIONS

Leffingwell et al., *Tobacco Flavoring for Tobacco Products*, pp. 11–14, 63, R. J. Reynolds Tobacco Co., 1972.

*Primary Examiner*—Jennifer Bahr

[57] ABSTRACT

A cigarette has a blend of tobacco materials and a filter element provided from a non-woven thermoplastic material. The non-woven material comprises polyester or polypropylene fibers. The non-woven material is in intimate contact with a high molecular weight material (e.g., an emulsifier or another polymeric material). As such the filter material is coated with another polymeric material. The coated non-woven material can be in intimate contact with an acidic material (e.g., lactic acid) or a basic material (e.g., sodium hydroxide). Certain cigarettes can have relatively high nicotine smokable blends and filter elements having the coated non-woven filter material in intimate contact with an acidic material. Certain other cigarettes can have relatively low nicotine smokable blends and filter elements having the coated non-woven filter material in intimate contact with a basic material. Certain other cigarettes can be "ultra low tar" cigarettes including filter elements having the coated non-woven filter material in intimate contact with a basic material.

7 Claims, 1 Drawing Sheet

CIGARETTE AND CIGARETTE FILTER ELEMENT THEREFOR

CROSS-REFERENCE TO RELATED APPLICATION

This is a continuation-in-part of U.S. patent application Ser. No. 868,925, filed Apr. 15, 1992, now abandoned the disclosure of which is incorporated herein by reference.

BACKGROUND OF THE INVENTION

The present invention relates to smoking articles such as cigarettes, and in particular to filter elements for cigarettes.

Popular smoking articles, such as cigarettes, have a substantially cylindrical rod shaped structure and include a charge of smokable material such as shredded tobacco (e.g., cut filler) surrounded by a paper wrapper, thereby forming a so-called "tobacco rod". It has become desirable to manufacture a cigarette having a cylindrical filter element aligned in an end-to-end relationship with the tobacco rod. Certain filter materials and filter elements are described in U.S. Pat. No. 4,729,390 to Mumpower, II. Typically, a filter element includes cellulose acetate tow circumscribed by plug wrap, and is attached to the tobacco rod using a circumscribing tipping material.

Cigarettes are employed by the smoker by lighting one end thereof and burning the tobacco rod. The smoker then receives mainstream smoke into his/her mouth by drawing on the opposite end (i.e., the filter end) of the cigarette. Drawn smoke passes through the filter element before reaching the mouth of the smoker.

Popular cigarettes classified as "full flavor" cigarettes deliver a desirable tobacco taste, flavor and satisfaction to the smoker. Typically, the "full flavor" cigarettes deliver about 14 mg or more of FTC "tar" per cigarette. A second classification of popular cigarettes is the "full flavor low tar" classification. Typically, the "full flavor low tar" cigarettes deliver from about 8 to about 14 mg of FTC "tar" per cigarette, as well as lower levels of FTC nicotine as compared to "full flavor" cigarettes. A third classification of popular cigarettes in the "ultra low tar" classification. Such "ultra low tar" cigarettes deliver still lower levels of FTC "tar" and nicotine. Typically, the "ultra low tar" cigarettes deliver less than about 7 mg of FTC "tar" per cigarette. The "full flavor low tar" and "ultra low tar" cigarettes conventionally have air dilution means such as laser perforations provided in the periphery of the mouthend region thereof, or have filter elements highly efficient for the removal of "tar" and nicotine from the mainstream aerosol.

It would be desirable to provide a cigarette which is capable of providing controlled yields of flavorful mainstream smoke. It would also be desirable to provide a cigarette filter element having a filter material which is coated or otherwise in intimate contact with a wide variety of materials.

SUMMARY OF THE INVENTION

The present invention relates to smoking articles, such as cigarettes. A smoking article of the present invention comprises a filter element. The filter element includes a segment (e.g., a rod shaped segment) having a filter material which preferably comprises thermoplastic fibers. The filter material comprising the thermoplastic fibers normally is a non-woven polymeric filter material. The filter material of at least one segment of the filter element is in intimate contact with at least one high molecular weight material. Such a high molecular weight material can be characterized as an oligomer, polymer or emulsifier. The high molecular weight material typically has an average molecular weight of about 400, often above about 1,000, and sometimes above 3,000. Typically, the amount of high molecular weight material treated with, and in intimate contact with the filter material, is at least about 5 percent, based on the weight of the filter material prior to treatment.

In one aspect, the filter element preferably includes a polymeric filter material in contact with at least one other polymeric material. The other polymeric material is in intimate contact with the filter material, and preferably covers the surface of the filter material as a coating or film. In another aspect, the filter element preferably includes a polymeric filter material in intimate contact with a high molecular weight emulsifier. The emulsifier preferably covers the surface of the filter material as a coating or film. If desired, the filter material can be coated or otherwise provided in intimate contact with two or more high molecular weight materials.

It is particularly desirable that the high molecular weight material completely cover the surface (e.g., the exposed surface) of the filter material. Normally, the high molecular weight material is dissolved or dispersed in a solvent suitable for that material, the resulting solution is applied to the filter material, and the coated filter material is subjected to conditions sufficient to cause evaporation of the solvent and hence leave the high molecular weight material in intimate contact with the filter material. As such, the surface character of the filter material is altered by application of at least one high molecular weight material thereto.

The filter element can include an acidic material or a basic material as a component thereof. The filter material is preferably in intimate contact with an additive including a basic material or an acidic material, either of which additive is capable of altering the characteristics of mainstream smoke which passes through the segment during use of the smoking article. Such a segment is referred to as a "smoke-altering filter segment." Normally, prior to smoking the cigarette, the smoke-altering filter segment includes at least about 0.1 percent acidic or basic material, based on the weight of the filter material of that segment.

The smoke-altering filter element can include a lubricating substance in intimate contact with the filter material. Normally, prior to smoking the cigarette, the smoke-altering filter segment includes at least about 0.1 percent lubricating substance, based on the weight of the filter material of that segment. The lubricating substance can be a low molecular weight liquid (e.g., glycerine) or a high molecular weight material (e.g., an emulsifier).

The smoke-altering filter segment optionally can include a tobacco extract in intimate contact with the filter material. If desired, the tobacco extract can be a spray dried tobacco extract, and the extract can be a spray dried extract which then has been subjected to heat treatment. Normally, prior to smoking the cigarette, the smoke-altering filter segment includes up to about 60 percent of the optional tobacco extract, based on the dry weight of the filter material and optional tobacco extract in intimate contact therewith.

Certain acidic materials are strong acids, such as phosphoric acid. Certain acidic materials are those which exhibit a $pK_a$ at 25° C. of less than about 3, and often less than about 2.5. Certain acidic materials are organic acids, such as levulinic acid, lactic acid and citric acid. Certain basic materials are strong bases, such as sodium hydroxide. Preferred basic materials are those which exhibit a $pK_b$ at 25° C. of less than about 3, and often less than about 2.5.

Preferred filter materials and high molecular weight materials contacting the filter materials, which also are intimately contacted with the acidic and basic materials, are essentially chemically inert with those acidic and basic materials under those conditions at which the smoking article into which the smoke-altering filter segment is incorporated is made, stored and used.

Other smoking articles of the present invention can include filter elements having the acidic and basic materials carried by another substrate, such as particles of carbon or alumina. Such substrates are particularly desirable for carrying strong acids or strong bases which may otherwise interact undesirably with other substrate materials, such as cellulose acetate tow fibers. The acidic and basic materials carried by such substrates which are relatively chemically inert or non-reactive relative to strongly acidic and basic materials then can be dispersed within the filter material of a filter segment or positioned within a cavity (e.g., within a cavity of a so-called "triple filter").

The filter element can include only a filter segment having the filter material thereof in contact with a high molecular weight material. However, the filter element preferably includes such a segment combined with at least one other filter segment. Normally, the segment, including the filter material in intimate contact with the high molecular weight material includes fibers of polyester, fibers of polyamide, or fibers of a polyolefin, such as polypropylene or polyethylene; and that filter segment can be combined with a filter segment which includes non-woven cellulose acetate tow or non-woven cellulose acetate web. If desired, the filter element can include (i) a smoke-altering filter segment containing an acidic material, (ii) a smoke-altering filter segment containing a basic material, and (iii) at least one other filter segment.

Of particular interest is a cigarette having a smokable filler material having a relatively high nicotine content, and a filter element including a smoke-altering filter segment. The smoke altering filter segment includes an acidic material in intimate contact with a substrate, which preferably is the coated filter material. Of particular interest is an organic acid which is contacted with the coated filter material so as to be in intimate contact with that coated filter material.

Also of particular interest is a cigarette which yields relatively low levels of "tar" per puff on average when smoked under FTC smoking conditions (e.g., an "ultra low tar" cigarette). Such a cigarette includes a smokable filler material and a filter element including a smoke-altering filter segment. The smoke-altering filter segment includes a basic material in intimate contact with a substrate, which preferably is the coated filter material.

Also of particular interest is a cigarette having a smokable filler material having a relatively low nicotine content, and a filter element including a smoke-altering filter segment. The smoking-altering filter segment includes a basic material in intimate contact with a substrate, which preferably is the coated filter material.

Smoking articles of the present invention (i.e., which have smoke-altering filter segments incorporated therein) can have various forms. Preferred smoking articles are rod shaped. For example, the smoking article can have the form of a cigarette having a smokable material (e.g., tobacco cut filler) wrapped in a circumscribing paper wrapping material. Exemplary cigarettes are described in U.S. Pat. Nos. 4,561,454 to Guess; 4,924,883 to Perfetti et al; 4,924,888 to Perfetti et al; 4,941,485 to Perfetti et al; 4,941,486 to Dube et al; 4,942,888 to Montoya et al, and 5,105,836 to Gentry et al; as well as U.S. patent application Ser. Nos. 528,302, filed May 24, 1990 and 601,551, filed Oct. 23, 1990. Other suitable smoking articles are described in U.S. Pat. Nos. 4,771,795 to White et al; 4,714,082 to Banerjee et al; 4,756,318 to Clearman et al; 4,793,365 to Sensabaugh et al; 4,827,950 to Banerjee et al; 4,938,236 to Banerjee et al; 4,955,399 to Potter et al, and 5,027,837 to Clearman et al; and European Patent Application Nos. 212,234; 277,519; 280,990 and 305,788; and U.S. patent application Ser. Nos. 574,327, filed Aug. 29, 1990 and 576,751, filed Aug. 29, 1990.

DETAILED DESCRIPTION OF THE PREFERRED EMBODIMENTS

Figure 1:
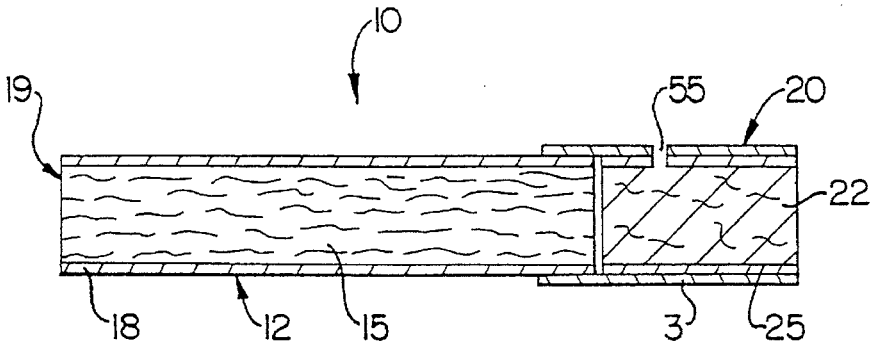
FIGS. 1, 2 and 3 are longitudinal, sectional views of rod-shaped smoking articles representative of the present invention.
Figure 2:
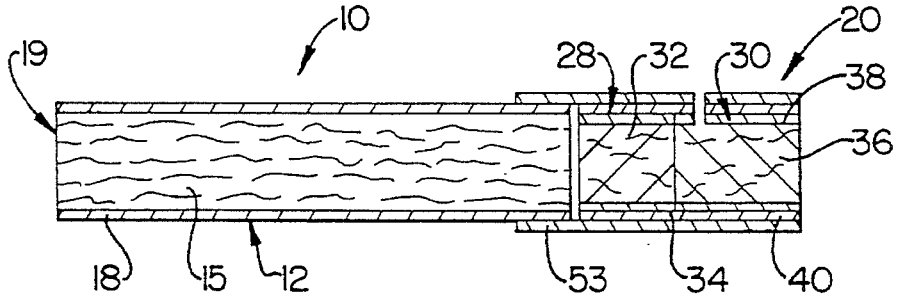

Representative embodiments of smoking articles of the present invention are shown in FIGS. 1 and 2. Cigarette 10 includes a generally cylindrical rod 12 of a charge or roll of smokable filler material 15 to be burned contained in circumscribing wrapping material 18. The rod 12 is conveniently referred to as a "smokable rod" or a "tobacco rod." The ends of the tobacco rod are open to expose the smokable filler material. The smokable rod is used by lighting one end 19 thereof, and aerosol (e.g., smoke) is provided as a result of the combustion of the burning smokable material. As such, the smokable rod burns from the lit end thereof towards the opposite end thereof.

Typically, the tobacco rod 12 has a length which ranges from about 50 mm to about 85 mm, and a circumference of about 16 mm to about 28 mm. The tobacco rods and the resulting cigarettes can be manufactured in any known configuration using known cigarette making techniques and equipment. The tobacco rod can have two layers of circumscribing paper wrapping material, if desired.

Referring to FIG. 1, cigarette 10 normally includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod 12. The ends of the filter element are open to permit the passage of air and smoke therethrough. The filter element 20 includes filter material 22 which is overwrapped along the longitudinally extending surface thereof with circumscribing plug wrap material 25.

Typically, the filter element 20 has a length which ranges from about 20 mm to about 35 mm and a circumference of about 16 mm to about 28 mm. The plug wrap 25 typically is a conventional paper plug wrap, and can be either air permeable or essentially air impermeable.

Filter element 20 includes a thermoplastic filter material 22, which is in intimate contact with a high molecular weight material (e.g., an emulsifier or another polymeric material), and optionally with a basic material or an acidic material. If desired, the filter material 22 can be in intimate contact with a lubricating substance. The filter element comprises sufficient acidic or basic material so as to be capable of altering the flavor characteristics of the mainstream smoke of the cigarette which passes through the filter element. As. such, there is provided a smoke-altering filter segment. If desired, the acidic material or basic material can be positioned at a relatively high concentration adjacent the tobacco rod, and be absent of or present at a very low concentration at the extreme mouthend of the filter element.

Referring to FIG. 2, cigarette 10 includes a filter element 20 having a first cylindrical filter segment 28 and second cylindrical filter segment 30. Filter element 20 has a generally cylindrical shape, and the diameter thereof is essentially equal to the diameter of the tobacco rod 12. The first and second segments are longitudinally disposed relative to one another. The first filter segment 28 is positioned adjacent one end of the tobacco rod 12, and the second filter segment is positioned adjacent one end of the first filter segment at the extreme mouth end of the cigarette. Either segment can include the thermoplastic polymeric material in contact with a high molecular weight material. The first filter segment 28 includes a first filter material 32 which is overwrapped along the longitudinally extending surface thereof with a circumscribing plug wrap material 34. The second filter segment 30 includes a second filter material 36 which is similarly overwrapped with a plug wrap material 38. The filter segments 28, 30 are axially aligned in an end-to-end relationship, preferably abutting one another; and are maintained in place by circumscribing outer plug wrap material 40. The inner surface of the outer plug wrap 40 is fixedly secured to the outer surfaces of the plug wraps of respective filter segments 28 and 30. The filter segments can be provided in the desired alignment using plug tube combination machinery which is familiar to the skilled artisan (e.g., using a Mulfi available from Hauni Werke Korber & Co. K.G.).

The first filter segment 28 can include filter material 32 in intimate contact with an acidic material or a basic material, and if desired, a lubricating substance, (e.g., glycerin or propylene glycol). That is, the first filter segment includes a filter material which includes thermoplastic fibers which are coated with a high molecular weight material, and is a smoke-altering segment. The second filter segment 30 normally includes filter material 36 which has the form of plasticized cellulose acetate tow, non-woven cellulose acetate web, polypropylene tow, gathered non-woven polypropylene web, or the like. The second segment can be a nonwrapped cellulose acetate filter element, if desired. Examples of cellulose acetate tow are tow items available as 8 denier per filament, 40,000 total denier; 2.7 denier per filament, 39,000 total denier; and 3 denier per filament, 35,000 total denier. Cellulose acetate tow typically is plasticized using triacetin. Most preferably, the filter materials of each of the first and second segments are different from one another. Flavors and other smoke modifying agents can be incorporated into the first and/or second filter segments, if desired. Various second segments can be provided from filter rods which are manufactured using known techniques and machinery.

Figure 3:
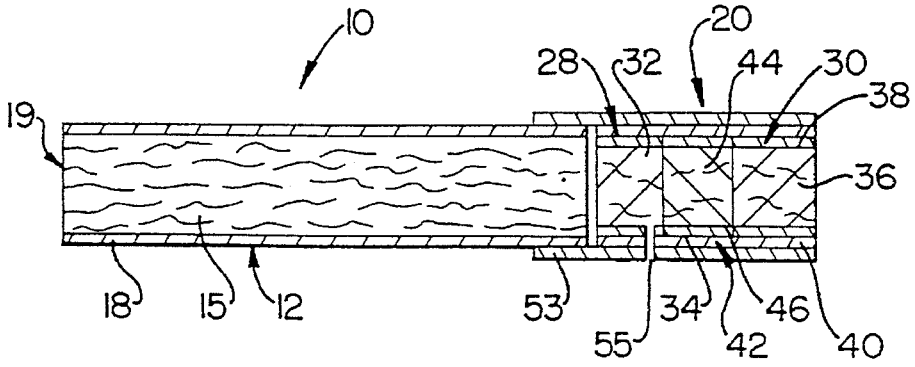

Referring to FIG. 3, cigarette 10 includes a filter element 20 having a first cylindrical filter segment 28, a second cylindrical filter segment 30, and a third cylindrical filter segment 42 positioned between the first and second filter segments. The third filter segment 42 includes a filter material 44 which is overwrapped with a plug wrap material 46. The filter elements 20, 28 and 42 are axially aligned in an end-to-end relationship, preferably abutting one another; and are maintained in place by at least one layer of circumscribing outer plug wrap material 40. At least one of the segments includes the filter segment of the invention.

The first filter segment 28 can include filter material 32 coated with a high molecular weight material and in intimate contact with a basic material; the second filter segment 30 includes filter material 36, such as cellulose acetate tow; and the third filter segment 42 includes filter material 44 coated with a high molecular weight material and in intimate contact with an acidic material. Alternatively, the filter segment having filter material in intimate contact with the acidic material can be positioned adjacent the tobacco rod, and the filter segment having filter material in intimate contact with the basic material can be positioned between the second filter segment 30 and the filter segment positioned adjacent the tobacco rod. If desired, the third filter segment can include a lubricating substance in intimate contact with the filter material of that segment.

Referring to FIGS. 1, 2 and 3, filter element 20 is attached to the tobacco rod 12 using tipping material 53 which circumscribes both the entire length of the filter element and an adjacent region of the tobacco rod. The inner surface of the tipping material 53 is fixedly secured to the outer surface of the filter element 20 and the outer surface of the wrapping material 18 of the tobacco rod, using a suitable adhesive. A preferred ventilated or air diluted cigarette is provided with an air dilution means such as a series of perforations 55 each of which extend through the tipping material and plug wrap. The series of perforations can be positioned such that air drawn through those perforations passes through at least a portion of the length of the first filter segment 28 to the mouth of the smoker, when two or more filter segments are incorporated in the filter element. Alternatively, the series of perforations can be positioned such that air drawn through those perforations enters the filter element through a filter segment positioned toward the mouthend of the cigarette relative to the first segment 28.

The filter materials useful for providing the smoke-altering filter segments can vary. Normally, the filter material is provided from a material which is a synthetic addition or condensation polymer. Polymers such as polyamides, polyesters, polypropylene or polyethylene are suitable. The filter material is essentially chemically inert to the basic materials and acidic materials in contact therewith. Preferred filter materials are synthetic polymers. Polymers such as acetylated cellulosics (e.g., cellulose acetate), particularly when in a fibrous tow form common for many cigarette filter elements, have a tendency to be chemically reactive with strong acids and strong bases. However, a filter material, such as cellulose acetate web or tow, can be coated with a polymeric material which has a tendency to not be chemically reactive with certain reagents, such as strong acids or bases.

One type of material useful for providing the filter material for the smoke-altering filter segment comprises polyester fibers. Polyesters are synthetic polymers which commonly are made by esterifying polybasic organic acids with polyhydric alcohols. For example, dimethyl terephthalate and ethylene glycol can be reacted to form polyethylene terephthalate. Polyester fibers can make up the total composition of the filter material. Preferably, the polyester fibers make up all or essentially all of the composition of the filter material of the smoke-altering segments of the filter element. Alternatively, that filter material can be a mixture or blend of polyester fibers with wood pulp, purified cellulose, polyolefin fibers (e.g., polyethylene or polypropylene fibers), cotton fibers, or the like. Typically, the filter material comprises at least about 25 percent polyester fibers, preferably at least about 40 percent polyester fibers, based on the weight of that filter material. The filter material can have the form of a non-woven web of fibers or a tow. Alternatively, the filter material can have a sheet-like form, particularly when the material is formed from a mixture of polyester fibers and wood pulp. Filter material in web or sheet-like form can be gathered, folded or otherwise formed into a suitable (e.g., cylindrical) configuration using techniques which will be apparent to the skilled artisan. See, for example, U.S. Pat. No. 4,807,809 to Pryor et al, and U.S. patent application Ser. No. 585,444, filed Sep. 20, 1990, which are incorporated herein by reference.

Another type of material useful for providing the filter material of the smoke-altering filter segment includes polyester fibers available as 4SW Fiber from Eastman Chemical Company. Such a material is particularly preferred, preferably such fibers make up all or essentially all of the composition of the smoke-altering segment of the filter element. A preferred filter material is a non-woven web comprising 4SW Fiber, and is available as 4TD Non-woven Web from Eastman Chemical Co. Preferably, such a filter material is provided as a sheet-like web in contact with about 0.1 to about 3 weight percent of a lubricant, such as mineral oil or polyethylene glycol monolaurate (e.g., PEG-600 monolaurate).

Another type of material useful for providing the filter material of the smoke-altering filter segment includes polyolefin fibers, such as polypropylene fibers. Preferably, the polypropylene fibers make up all or essentially all of the composition of the filter material of the smoke-altering segment of the filter element. A highly preferred sheet-like web of non-woven polypropylene fiber is available as PP200SD from Kimberly-Clark Corp. Such a web can be manufactured using a melt blowing process as is described in U.S. Pat. No. 3,849,241 to Buntin et al. See, for example, European Patent Application No. 330,709, which is incorporated herein by reference.

Another type of material useful for providing the filter material of the smoke-altering filter segment includes polyolefin fibers, such as polyethyiene fibers. Polyethylene fibers can make up the total composition of the filter material of the smoke-altering filter segment. Preferably, the polyethylene fibers made up all or essentially all of the composition of the filter material of the smoke-altering segments of the filter element. Alternatively, that filter material can be a mixture or blend of polyethylene fibers with wood pulp, purified cellulose, polypropylene fibers, polyester fibers, cotton fibers, or the like. Typically, the filter material comprises at least about 25 percent polyethylene fibers, preferably at least about 40 percent polyethylene fibers, and often greater than 50 percent polyethylene fibers, based on the weight of that filter material. The filter material can have the form of a non-woven web of fibers or a tow. Alternatively, the filter material can have a sheet-like form, particularly when the material is formed from a mixture of polyethylene fibers and wood pulp. Filter material in web or sheet-like form can be gathered, folded or otherwise formed into a suitable (e.g., cylindrical) configuration using techniques which will be apparent to the skilled artisan.

Combinations of various synthetic addition or combination polymers can be used as the smoke-altering filter material in intimate contact with smoke-altering materials, such as acids or bases. Second filter segments can be synthetic polymers, cellulosics, acetylated cellulosics, cotton fibers, or combinations or composites of the above filter materials. However, filter materials consisting essentially of the synthetic addition or condensation polymers (e.g., polyolefins or polyesters) are particularly preferred, as those filter materials tend not to be chemically interactive to a significant degree with the smoke-altering materials in intimate contact therewithin. Of particular interest are filter materials which do not exhibit a propensity to undergo hydrolysis or otherwise experience an undesirable chemical reaction, when contacted with a relatively strong acidic material or a relatively strong basic material.

The filter material of the smoke-altering filter segment (e.g., the polyester or polypropylene filter materials) can be combined with at least one other polymeric material to provide for a treated filter material capable of altering the chemistry of tobacco smoke, when such treated filter material is used as a filter segment in a cigarette. A solution or dispersion is prepared by contacting a polymeric material (e.g., a polar polymeric material) with a suitable solvent (e.g., water, ethanol, acetone, methyl ethylketone, toluene, or the like). The solution or polymer and solvent can be applied to the surface of the filter material using gravure techniques, spraying techniques, printing techniques, immersion techniques, injection techniques, or the like. Most preferably, the filter material is essentially insoluble in the solvent for the polymer. Hence the solvent does not have a tendency to harm to any significant degree, the general structure of the filter material. Then, solvent is removed from the treated filter material by application of heat (e.g., using a forced air heated oven). The amount of solution of polymer and solvent which is applied to the filter material is such that the outer surface of the filter material is essentially completely covered by the solution. However, it is desirable that the void spaces between the fibers of filter material not be completely filled by the polymer which is coated onto that material. Typically, the amount of polymer applied to the filter material is at least about 5 percent, normally at least about 8 percent, often at least about 10 percent, and frequently at least about 15 percent, based on the weight of the filter material prior to treatment. Typically, the amount of polymer applied to the filter material does not exceed about 35 percent, normally does not exceed about 30 percent, and frequently does not exceed about 25 percent, based on the weight of the filter material prior to treatment. However, certain polymers (e.g., natural polymers such as carrageenans and alginates) can be applied to the filter material at very low levels. Typically, natural polymers tend to coat the surface of the filter material very efficiently, and have a high viscosity, making high coating levels unnecessary and difficult. Typically certain natural polymers can be applied to the filter material at levels of at least about 0.001 percent, usually at least about 0.01 percent, often at least about 0.1 percent, and even at least about 1 percent, based on the weight of the filter material prior to treatment. Typically, the amount of certain natural polymers applied to the filter material does not exceed about 10 percent, and normally does not exceed about 5 percent, based on the weight of the filter material prior to treatment.

The polymeric material which is applied to the filter material can vary, depending upon factors such as the chemical functionality, hydrophilicity or hydrophobicity desired. If desired, more than one type of polymeric material can be applied to the filter material. If desired, the filter material can have at least one type of polymeric material dissolved or dispersed in a suitable solvent applied thereto, and the solvent can be removed (e.g., by drying); and the resulting coated filter material can have at least one further type of polymeric material dissolved or dispersed in another suitable solvent applied thereto, and that further solvent can be removed. In such a circumstance, it is highly desirable that the further solvent for the further polymeric material not be a good solvent for the filter material and the polymeric material which previously had been applied to the filter material.

The polymer can be synthetic polymer or a natural polymer. Synthetic polymers are derived from the polymerization of monomeric materials (e.g., addition or condensation polymers) or are isolated after chemically altering the substituent groups of a polymeric material. Natural polymers are isolated from organisms (e.g., plants such as seaweed), usually by extraction.

Exemplary polymers include carboxymethylcellulose, hydroxypropylcellulose, cellulose esters (e.g., cellulose acetate, cellulose butyrate and cellulose acetate propionate), polyethylene glycols, water dispersible amorphous polyesters with aromatic dicarboxylic acid functionalities (e.g., the AQ polymers, such as AQ 555, from Eastman Chemical Corp.), ethylene vinyl alcohol copolymers (e.g., MICA G-894 from Mica Corp.) partially or fully hydrolyzed polyvinyl alcohols (e.g., the Vinols from Air Products), ethylene acrylic acid copolymers (e.g., Adcote 50T 4990 from Morton International and Primacor 5990 from The Dow Chemical Co.), alginates (e.g., Kelcoloid HVF, Superloid, Keltose and Keltrol SF from Kelco Div. of Merck & Co., Inc.), carrageenans (e.g., Viscarin GP109 and Nutricol GP120F konjac flour from FMC) and starches (e.g., Nadex 772, K-4484 and N-Oil from National Starch & Chemical Co.).

As the composition of the filter material, the form of the filter material and the configuration of the filter material can vary, the filtration efficiency for particulate matter and vapor phase components of each ultimate filter segment can vary from relatively low to relatively high. Filter materials in tow form can be processed and manufactured into filter rods using known techniques. Filter materials in sheet-like or web form can be formed into rods using techniques described in U.S. Pat. Nos. 4,807,809 to Pryor et al, and 5,074,320 to Jones, Jr. et al, and in U.S. patent application Ser. No. 585,444, filed Sep. 20, 1990. Filter materials also can be formed into rods using a rod making unit available as CU-10 or CU-10S from Decoufle s.a.r.b., together with a KDF-2 rod making apparatus from Hauni-Werke Korber & Co., K.G.; or as set forth in U.S. Pat. No. 4,283,186 at col. 4, line 50 through col. 5, line 6.

The acidic materials are materials or substances which behave as Bronstead acids, and have functionalities which can provide protons. Acidic materials which are employed often are strong acids, and typically are water soluble inorganic acids. Typical acidic materials are those which exhibit a $pK_a$ at 25° C. of less than about 3, preferably less than about 2.5, more preferably less than about 2 and most preferably less than about 1. Exemplary inorganic acids are phosphoric acid and sulfuric acid. Other acidic materials are organic acids. Typical organic acids comprise at least one carboxylic acid functionality. Exemplary organic acids include levulinic, pyruvic, malic, malonic, maleic, tartaric, citric, potassium hydrogen phthalate, oxalic, lactic, fumaric, adipic, acetic, propionic, phenylacetic, butyric isovaleric, caproic, caprylic and capric acids. Exemplary organic acids also can include the amino acids, such as serine, threonine, phenylalanine, glutamine, proline, asparagine, aspartic acid and glutamic acid. Certain acids, such as the amino acids, contain both acidic and basic functionalities.

The basic materials are materials or substances which behave as Lewis bases, and have functionalities which can provide electron pairs. Basic materials which are employed often are strong bases, and typically are water insoluble inorganic bases. Typical basic materials are those which exhibit a $pK_b$ at 25° C. of less than about 3, preferably less than about 2.5, more preferably less than about 2, and most preferably less than about 1. Exemplary inorganic bases are metal hydroxides (e.g., sodium and potassium hydroxides). Other basic materials are organic bases, such as urea.

A typical filter material in intimate contact with the basic material or acidic material includes up to about 50 percent, usually up to about 30 percent and frequently up to about 10 percent basic material or acidic material, based on the weight of the filter material of the smoke-altering filter segment, prior to the time that the cigarette into which the resulting filter segment is incorporated is smoked. A typical filter material in intimate contact with the basic material or acidic material includes more than about 0.1 percent, usually more than 0.5 percent, frequently more than 1 percent, and sometimes more than about 3 percent basic material or acidic material, based on the weight of the filter material of the smoke-altering filter segment. Certain filter materials include about 2 to about 5 percent acidic material or basic material in intimate content therewith, based on the weight of the filter material of the smoke-altering filter segment.

The amount of acidic material or basic material within the smoke-altering filter segments of cigarettes of the types described with reference to FIGS. 1, 2 and 3 (i.e., cigarettes which burn smokable material, such as tobacco cut filler, present in the smokable rod to produce mainstream smoke) typically incorporate up to about 15 percent, and frequently up to about 10 percent acidic material or basic material within the smoke-altering filter segment, based on the weight of the smokable material within the cigarette. Typically, cigarettes having the smoke-altering filter segments incorporate more than about 0.02 percent, generally more than about 0.1 percent, usually more than about 0.5 percent, often more than about 1 percent, and frequently more than about 5 percent acidic material or basic material, based on the weight of the smokable material within the cigarette. Certain cigarettes having the smoke-altering filter segments incorporate about 0.1 to about 6 percent acidic or basic material, based on the weight of the smokable material within the cigarette.

A typical smoke-altering filter material having a basic material in intimate contact with a filter material exhibits a solution pH at 25° C. of about greater than about 8 units, usually greater than about 9 units, and frequently greater than about 10 units.

A typical smoke-altering filter material having an acidic material in intimate contact with a filter material exhibits a solution pH at 25° C. of less than about 6 units, usually less than about 4 units, and frequently less than about 2 units.

For purposes of the present invention, the pH of the smoke-altering filter material is determined by contacting the filter segment with distilled water, and measuring the pH of the resulting liquid is measured using a properly calibrated hydrogen ion electrode pH meter. As such, the pH of the filter segment is a so-called "solution pH."

The manner in which the smoke-altering filter segments are provided can vary. Typically, the acidic material or basic material is provided within a liquid (e.g., water) and the liquid is applied to a web or sheet of the coated filter material using a rotogravure or size press technique, and the web or sheet is removed from the liquid. If desired, the acidic material or basic material can be provided within a liquid (e.g., water) and then sprayed onto the filter material or injected into contact with the filter material. The acidic material or basic material can be applied to one or all sides of the filter material. If desired, the acidic material or basic material can be applied to a web of filter material in the form of a pattern using printing techniques, electrostatic deposition techniques, or the like. As such, all or a portion of the filter material can be in intimate contact with the acidic material or the basic material. Significant amounts of liquid (e.g., water) are removed from the filter material prior to use of that material as a smoke-altering filter segment.

Tobacco extracts which optionally are intimately contacted with the filter materials preferably are tobacco extracts which are provided by extracting a tobacco material with a solvent having an aqueous character (i.e., a solvent consisting primarily of water, preferably greater than 90 weight percent water, and often essentially pure water). Organic solvents also can be employed. The specific composition of the tobacco extract can vary, depending upon factors such as the type Typical filter materials in intimate contact with the optional tobacco extract include up to about 60 percent, preferably about 5 to about 55 percent, more preferably about 10 to about 45 percent, and most preferably about 20 to about 40 percent tobacco extract, based on the total dry weight of the filter material, high molecular weight coating material and optional tobacco extract, prior to the time that the cigarette into which the resulting filter element is incorporated is smoked.

The acidic materials can be combined with one another and/or with salts; and the basic materials can be combined with one another and/or with salts. Such salts include inorganic salts of organic acids, salts of inorganic acids and organic salts of organic acids. Exemplary salts include the sodium, potassium, calcium and magnesium salts of the previously mentioned organic acids; the sodium, potassium, calcium and magnesium salts of phosphoric acid, boric acid, and carbonic acid; ammonium salts of phosphoric acid, carbonic acid and the previously mentioned organic acids; and the nicotine salts of the previously mentioned organic acids. The nicotine salts of the organic acids typically have molar ratios of organic acid to nicotine of 1:1, 2:1 and 3:1. Exemplary nicotine salts of organic acids are set forth in U.S. Pat. No. 4,830,028 to Lawson et al, which is incorporated herein by reference. The selection of the particular salt depends upon factors such as the acidic material or basic material which is in intimate contact with the filter material of the smoke-altering filter segment.

The amount of optional salt which is intimately contacted with the filter material can vary; but typically is less than about 5 percent, based on the of tobacco material which is extracted, the extraction solvent and the type of extraction conditions. Although the nicotine contents of such extracts can vary, preferred tobacco extracts have nicotine contents of less than about 50 percent, usually of less than about 25 percent, and frequently less than about 15 percent, based on the dry weight of the extract. Such preferred tobacco extracts have relatively high contents of many of the flavorful components of tobacco. Representative methods for preparing and processing tobacco extracts are set forth in European Patent Application Nos. 326,370 and 338,831, which are incorporated herein by reference. Other tobacco extracts are those extracts which are subjected to heat treatment, such as those tobacco extracts set forth in U.S. Pat. No. 5,060,669 to White et al, which is incorporated herein by reference.

Typically the tobacco extract is provided within a liquid, applying the liquid and extract to a web or sheet of the coated filter material using a rotogravure or size press technique, and removing the liquid from the web or sheet. If desired, the tobacco extract can be provided within a liquid carrier, and then sprayed onto the filter material. The optional tobacco extract can be contacted with the filter material before, while, or after, the acidic material or basic material is contacted with the filter material. The tobacco extract can be a spray dried extract, a freeze dried extract or a tobacco essence which is in turn dissolved or otherwise dispersed in water or other liquid carrier in order to be applied to the filter material. Typically, the tobacco extract which optionally is in intimate contact with the filter material has a moisture content of about 5 to about 6 weight percent, although the moisture content of a particular tobacco extract can vary. weight of the filter material of the smoke-altering filter segment.

The filter materials also can include certain amounts of lubricating substances. The lubricating substances can have a high molecular weight or a low molecular weight. Exemplary lubricating substances include polyhydric alcohols (e.g., glycerin, propylene glycol, or the like), fatty acids, mineral oils, vegetable oils and polyethylene glycol esters of fatty acids. Also useful are emulsifiers such as triglycerides of fatty acids. Suitable emulsifiers are available as Myvacet, Myvaplex, Myvatex, Myverol and Myvatem from Eastman Chemical Co. Other lubricating substances are liquid carbohydrates provided by the hydrolysis and hydrogenation of corn or corn by-products and are di-, tri-, or tetra- sugar alcohols, or mixtures of such sugar alcohols. Certain lubricating substances are available from Lonza, Inc. as Hystar CG, TPF, 7000, HM75, HM70, 3375, 4075, 6075 and 5875, and as Glystar (e.g., a mixture of Hystar HM70 or HM75 with glycerine). Certain lubricating substances are available from Union Carbide Corp. as Carbowax 200, 300, 400, 540, 600, 900, 1000, 1450, 3350, 4600 and 800, and as Carbowax Methoxy Polyethylene Glycol 350, 550, 750, 200 and 5000. Blends or combinations of different lubricating substances, and mixtures of high and low molecular weight lubricating substances, can be employed.

The lubricating substance provides flexibility to the web or tow; improves the ability of additives to spread evenly throughout the filter material; and provides a web or tow which can be shaped without the application of heat. For example, certain lubricating substances facilitate even coating of the acidic material or basic material throughout the smoke-altering filter segment, particularly by facilitating solubility to some degree of the acidic material or basic material in that lubricating substance. Certain lubricating substances act as non-aqueous solvents for dispersing certain substances (e.g., organic acids, such as citric acid, levulinic acid and lactic acid) throughout the smoke-altering filter segment, so as to maintain those substances in a liquid phase and to control the vapor pressure of those substances. For example, the lubricating substances can act to disperse certain substances and maintain those substances in a generally liquid form; and as such, those substances in intimate contact with the filter material are not present to any significant degree in a solid, powder or crystalline form. Lubricating substances in contact with certain acidic materials and basic materials tend to reduce the propensity of acidic materials and basic materials to transfer into mainstream smoke; and lubricating substances provide for a large amount of contact area of the acidic materials or basic materials with mainstream smoke which passes through the smoke-altering filter segment. In addition, certain lubricating substances can introduce to some degree improved organoleptic characteristics (e.g., a smoothing effect) to mainstream smoke which passes through the smoke-altering filter segment.

Typical filter materials in intimate contact with the lubricating substance include up to about 40 percent, often up to about 30 percent, and frequently up to about 20 percent lubricating substance, based on the total dry weight of the coated filter material of the smoke-altering filter segment, prior to the time that the cigarette into which the resulting filter segment is incorporated is smoked. Typical coated filter materials in intimate contact with the lubricating substance include more than about 0.1 percent, generally more than about 1 percent, often more than about 3 percent, and frequently more than about 5 percent lubricating substance, based on the weight of the filter material of the smoke-altering filter segment. The lubricating substance is intimately contacted with the filter material and is contacted with that filter material in much the same manner as is the acidic or basic materials. In certain instances, the lubricating substance can be applied to the filter material along with the acidic material or basic material. Certain lubricating substances can be dissolved or dispersed in a solvent having an aqueous character and applied to the filter material. In certain circumstances, a surfactant (e.g., a surfactant available from Sigma Chemical Co. as Polysorbate 80, or Tween 80, 40, 60 and 85) can be combined with the lubricating substance and solvent to enhance solubility of that substance in the solvent. Alternatively, a non-aqueous solvent such as an organic solvent (e.g., a ketone, such as methyl ethylketone, or an alcohol, such as ethanol) can be used as a solvent to dissolve certain lubricating substances (e.g., certain polyethylene glycols and certain methoxy polyethylene glycols). As such, the various lubricating substances can be applied to the filter material (e.g., using injection, immersion, spraying or printing techniques) and significant amounts of the solvent can be removed (e.g., by suitable drying techniques) to provide the filter material in intimate contact with the lubricating substance. The lubricating substance can be applied to the filter material so that all or a portion of the filter material is in intimate contact with the lubricating substance.

When the lubricating substance is employed with the acidic material or basic material, the amount of those substances in intimate contact with the substrate of the smoke-altering filter segment can vary. Typically, the amount of those substances in intimate contact with the filter material includes up to about 50 percent, generally up to about 40 percent, often up to about 30 percent and frequently up to about 20 percent of the smoke-altering filter segment, based on the weight of the filter material of the smoke-altering filter segment. Typically, the amount of those substances in intimate contact with the filter material includes at least about 0.2 percent, generally at least about 1 percent, often at least about 3 percent, and frequently at least about 5 percent of the smoke-altering filter segment, based on the weight of the filter material of the smoke-altering filter segment. Certain filter materials include about 10 to about 20 percent lubricating substance in intimate contact therewith, based on the weight of the filter material of the smoke-altering filter segment. The relative amounts of lubricating substance and acidic or basic materials can vary; and the amount of acidic or basic materials can range from about 1 to about 99 percent, often about 20 percent to about 80 percent, and frequently about 40 to about 60 percent, based on the combined weight of the lubricating substance and acidic or basic material; while the amount of lubricating substance can range from about 99 percent to about 1 percent, often about 80 percent to about 20 percent, and frequently about 60 percent to about 40 percent, based on the combined weight of the lubricating substance and acidic or basic materials.

Other mainstream smoke altering materials which include materials for enhancing the flavor characteristics of the mainstream smoke also can be employed. Such further materials include those flavoring agents set forth in Leffingwell et al, *Tobacco Flavoring for Smoking Products* (1972). Exemplary further material include cocoa, licorice, sugars, syrups, menthol and spearmint, as well as Amadori compounds and amino sugars (e.g., glucosamine and asparaginofructose). Other further material include vitamins and vitamin precursors. Specific other further materials include Vitamins A, C, D, E, K and B-complexes, and compounds such as carotenoids, xanthrophyl and chlorophyll. The optional further material can be contacted with the filter material by injection techniques, size press techniques, rotogravure techniques, or the like. The further material can be contacted with the filter material before, while, or after, the polymeric material the acidic material, basic material and/or lubricating substance is contacted with the filter material.

The filter material which are in intimate contact with the high molecular weight material also can be contacted with solid, particulate materials. For example, solid particles can be applied to a web prior to the time that the web is gathered to form a filter rod. The particulate material can be sprinkled or dropped onto the web, or the particulate material can be dispersed in a liquid (e.g., glycerine) and applied as a slurry to the web. Exemplary particulate materials include carbon particles, particulate cellulosies and calcium carbonate particles. See, also, certain of those filler materials set forth in U.S. Pat. No. 5,129,408 to Jakob, et al, which is incorporated herein by reference.

The smokable materials useful herein can vary. Examples of highly preferred smokable materials are the tobacco materials which include flue-cured, Oriental, Maryland and Burley tobaccos, as well as the rare and specialty tobaccos. Generally, the tobacco material has been aged. The tobacco material can be in the form of tobacco laminae, processed tobacco stems, reconstituted tobacco material, volume expanded tobacco filler, or blends thereof. The type of reconstituted tobacco material can vary (i.e., the reconstituted tobacco material can be manufactured using a variety of reconstitution processes). Certain suitable reconstituted tobacco materials are described in U.S. patent application Ser. No. 710,273, filed Jun. 4, 1991. Certain volume expanded tobacco materials are described in U.S. Pat. No. 5,095,922 to Johnson et al. Blends of the aforementioned materials and tobacco types can be employed. Exemplary blends are described in U.S. Pat. No. 5,074,320 to Jones, Jr. et al. Other smokable materials, such as those smokable materials described in U.S. Pat. No. 5,074,321 to Gentry et al, and 5,056,537 to Brown et al, also can be employed. The smokable materials generally are employed in the form of cut filler as is common in conventional cigarette manufacture. For example, the smokable filler material can be employed in the form of pieces, shreds or strands cut into widths ranging from about 1/5 inch to about 1/60 inch, preferably from about 1/20 inch to about 1/40 inch. Generally, such pieces have lengths which range from about 0.25 inch to about 3 inches.

The smokable material can have a form (e.g., be employed as a blend of smokable materials, such as a blend of various types of tobacco in cut filler form) having a relatively high nicotine content. Such a smokable material typically has a dry weight nicotine content above about 2.25 percent, often above about 2.5 percent, sometimes above about 2.75 percent, and occasionally above about 3.0 percent. See, U.S. Pat. No. 5,065,775 to Fagg and Lawson et al, in U.S. Pat. No. 4,836,224 at col. 5, line 11, through col. 6, line 32.

The smokable material can have a form (e.g., be employed as a blend of smokable materials, such as a blend of various types of tobacco in cut filler form) having a relatively low nicotine content. Such a smokable material typically has a dry weight nicotine content below about 1.5 percent, often below about 1.0 percent, and frequently below about 0.5 percent. See U.S. Pat. Nos. 5,025,812 to Fagg et al, and 5,065,775 to Fagg, and European Patent Application Nos. 280,817 and 323,699.

As used herein, the term "dry weight nicotine content" in referring to the smokable material is meant the mass alkaloid nicotine as analyzed and quantitated by spectroscopic techniques divided by the dry weight of the smokable material analyzed. See, Harvey et al, Tob. Sci., Vol. 25, p. 131 (1981).

The filler materials can be employed with or without casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. See, for example, U.S. Pat. No. 4,830,028 to Lawson et al.

The wrapping material which circumscribes the charge of smokable filler can vary. Examples of suitable wrapping materials are cigarette paper wrappers available as Ref. No. 419, 454, 455 and 456 from Ecusta Corp. and as Ref No. 719, 754, 756, 854 and 856 from Kimberly-Clark Corp. Also suitable are cigarette paper wrappers available as P-2123-101, P-2123-102, P-2123-104, P-2123-106, P-2123-107, P-2123-108, P-2123-109, P-2123-111, P-2123-112, P-2123-114, from Kimberly-Clark Corp.; and cigarette paper wrappers available as TOD 01788, TOD 03363, TOD 03732, TOD 03957, TOD 03949, TOD 03950, TOD 03953, TOD 03954, TOD 04706, TOD 04742 and TOD 04708 from Ecusta Corp. Certain additives can be incorporated into the wrapping material as described in U.S. Pat. No. 4,941,486 to Dube et al. Certain paper wrappers have low inherent air permeabilities (e.g., permeabilities of less than about 15 CORESTA units). A particularly preferred paper wrapper is a low permeability, high basis weight paper having a high surface area calcium carbonate filler and a relatively high application of potassium succinate burn additive. Such a paper is available as P-2123-114 from Kimberly-Clark Corp. Another suitable paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such papers are available as TOD 03732 and TOD 04742 from Ecusta Corp. Also useful are those wrapping materials described in U.S. patent application Ser. No. 842,276, filed Feb. 26, 1992. More than one layer of circumscribing wrapping material can be employed, if desired. See, for example, those smokable rods described in U.S. patent application Ser. Nos. 661,747, filed Feb. 27, 1991 and 759,266, filed Sep. 13, 1991, which are incorporated herein by reference.

The amount of smokable material within the tobacco rod can vary, and can be selected as desired. Typical packing densities for tobacco rods of cigarettes of the present invention range from about 150 to about 300 mg/cm$^3$, and often from about 200 to about 280 mg/cm$^3$.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette. The air dilution means can be positioned along the length of the cigarette at a point along the filter element which is at a maximum distance from the extreme mouthend thereof. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element. In a preferred aspect, the air dilution means is positioned toward the extreme mouthend of the cigarette relative to the smoke-altering filter segment. For example, for a filter element having a 27 mm length including a smoke-altering filter segment of 12 mm length and a mouthend segment of 15 mm, a ring of air dilution perforations can be positioned either 13 mm or 15 mm from the extreme mouthend of the filter element. As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of this invention, the amount of air dilution can vary. Generally, the amount of air dilution for an air diluted cigarette is greater than about 10 percent, typically greater than about 20 percent, and often greater than about 30 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent. Certain relatively high air diluted cigarettes have air dilution amounts of about 50 to about 75 percent, often about 55 to about 70 percent.

Certain cigarettes of the present invention yield less than about 0.9, often less than about 0.5, and usually between about 0.05 and about 0.3 FTC "tar" per puff on average when smoked under FTC smoking conditions. Such cigarettes are "ultra low tar" cigarettes which yield less than about 7 mg FTC "tar" per cigarette. Typically, such cigarettes yield less than about 9 puffs, and often about 6 to about 8 puffs, when smoked under FTC smoking conditions. Such cigarettes preferably include a smoke-altering filter segment having a basic material in intimate contact with the filter material thereof. The smoke-altering filter segment provides for an enhanced tobacco smoke flavor, a richer smoking character, enhanced-mouthfeel and increased smoking satisfaction, as well as improvement of the perceived draw characteristics of the cigarette.

Certain cigarettes of the present invention yield more than about 0.1, often more than about 0.2, and frequently more than about 0.3 FTC nicotine per puff on average when smoked under FTC smoking conditions. Such cigarettes typically yield between about 1 mg and about 20 mg, and often about 2 mg to about 15 mg FTC "tar" per cigarette. Cigarettes yielding about 14 to about 20 mg of FTC "tar" normally have FTC "tar" to FTC nicotine ratios of less than about 15, and often less than about 13. Cigarettes yielding less than about 14 mg of FTC "tar" normally have FTC "tar" to FTC nicotine ratios of less than about 9, often less than about 8, frequently less than about 7, and even less than about 6. Such cigarettes include a smoke-altering filter segment having an acidic material in intimate contact with the filter material thereof. The smoke-altering filter segment provides for smooth, non-irritating, rich tobacco smoke flavor which provides an overall satisfying character to the mainstream smoke of the cigarette.

Certain cigarettes of the present invention yield less than about 0.1, often less than about 0.05, frequently less than about 0.01, and even less than about 0.005 FTC nicotine per puff on average when smoked under FTC smoking conditions. Such cigarettes typically yield between about 1 mg and about 20 mg, often about 2 mg to about 15 mg FTC "tar" per cigarette; and normally have relatively high FTC "tar" to FTC nicotine ratios of between about 20 and about 150. Such cigarettes include a smoke-altering filter segment having a basic material in intimate contact with the filter material thereof. The smoke-altering filter segment provides for an enhanced tobacco smoke flavor, a richer smoking character, enhanced mouthfeel and increased smoking satisfaction, as well as improvement of the perceived draw characteristics of the cigarette.

FTC smoking conditions consist of 35 ml puffs of 2 second duration separated by 58 seconds of smolder.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

The following examples are provided in order to further illustrate various embodiments of the invention but should not be construed as limiting the scope thereof. Unless otherwise noted, all parts and percentages are by weight.

EXAMPLE 1

Cigarettes substantially as shown in FIG. 2 are prepared as follows:

The cigarettes have a length of about 84 mm and a circumference of about 24.8 mm, and include a smokable rod having a length of about 57 mm and a filter element having a length of about 27 mm. Each smokable rod comprises a charge of smokable material circumscribed by a single layer of paper wrapper. The weight of the smokable material within each smokable rod is about 0.65 g. Each filter element includes two segments. The first filter segment is positioned adjacent the smokable rod. The second segment includes cellulose acetate tow (2.1 denier per filament/48,000 total denier) plasticized with triacetin and circumscribed by non-porous paper plug wrap. The second filter segment has a length of 15 mm, and is positioned adjacent the first filter segment. Each filter element is attached to each tobacco rod using non-porous tipping paper. For each cigarette, the tipping paper circumscribes the filter element and a 4 mm length of the tobacco rod in the region adjacent the filter element. The cigarettes are air diluted to a level of about 20 percent by providing a ring of perforations through the tipping material and plug wrap about 13 mm from the extreme mouthend of the cigarette.

The filter material of the first filter segment is a continuous non-woven sheet-like web available as 4TD from Eastman Chemical Co. The web includes polyester fibers available as 4SW from Eastman Chemical Company. The web has a basis weight of about 1.0 oz/yd$^2$, and a width of about 9.25 inches. The web has about 0.3 percent mineral oil applied thereto.

The filter material of the first filter segment is treated with a solution as follows: A polyethylene glycol available as Carbowax 1000 from Union Carbide Corp. is provided. The Carbowax 1000 is mixed with water such that a solution of about 20 percent high molecular weight material in water is provided. The solution is uniformly applied to the surface of the polyester fiber web using an 85 Quad gravure cylinder on a Faustel Laminator. The resulting coated web is dried convectively using air heated at about 170° F. The dry coated web includes a single pass coating of about 3.7 lb/3000 sq. ft., and includes about 19.7 percent polyethylene glycol in intimate contact with the polyester fiber web, based on the original weight of the polyester web. As such, a filter material in intimate contact with polyethylene glycol is provided. The first filter segment is provided by subdividing a rod provided by gathering the continuous web from a bobbin. The apparatus is similar to that rod making apparatus described in Example 1 of U.S. Pat. No. 4,870,809 to Pryor et al, and includes a constriction member (i.e., tongue) fashioned so that a continuous supply of water is applied to the web-contacting surface of the tongue. See, U.S. patent application Ser. No. 585,444, filed Sep. 20, 1990. Each 12 mm filter segment so provided includes a circumscribing non-porous paper plug wrap, and weighs about 0.1 g.

The paper wrapper of the smokable rod comprises flax and calcium carbonate. The paper wrapper is available as Reference No. 854 from Kimberly-Clark Corp.

The smokable material is a blend of volume expanded flue-cured and Burley tobacco laminae, flue-cured tobacco laminae, Burley tobacco laminae, reconstituted tobacco and Oriental tobacco laminae. The smokable material is in the form of laminae cut into strands at 32 cuts per inch. The volume expanded tobacco is tobacco laminae which is cut into cut filler form and which has been expanded. The nicotine content of the blend is about 2.3 percent.

The blend of smokable materials is cased and top dressed with humectants and flavors, and is provided so as to have total moisture content of about 12 percent.

The cigarettes then are employed by burning the smokable rod such that the blend of smokable material within the paper wrapper burns to yield smoke. The cigarette yields a satisfying, rounded smoking character.

EXAMPLE 2

Cigarettes are provided generally as described in Example 1. However, the filter segment is provided by treating the polyester fiber web with an aqueous solution of a polyethylene glycol available as Carbowax 400 from Union Carbide, in essentially the manner described in Example 1. The resulting dry coated web includes about 15 percent of the polyethylene glycol in intimate contact with the polyester fiber web, based on the original weight of the polyester web. Cigarettes are provided as described in Example 1 by attaching a two-segment filter element of the type described in Example 1 to one end of the tobacco rod. The cigarettes are air diluted to a level of 20 percent by providing a ring of perforations through the tipping material and plug wrap about 13 mm from the extreme mouthend of the cigarette.

EXAMPLE 3

Cigarettes are provided generally as described in Example 2. However, a solution of 1 part polyvinyl alcohol in 10 parts water is applied uniformly to the polyester web, and the resulting coated web is dried. The polyvinyl alcohol is available as Airval 425 from Air Products and Chemicals Inc. The dry coating weighs about 5.4 lb/3000 $ft^2$, and the coating provides about 23 percent of the weight of the coated web, based on the original weight of the polyester web. Filter elements then are provided essentially as described in Example 1.

EXAMPLE 4

Cigarettes are provided generally as described in Example 2. However, a solution of 1 part cellulose acetate (i.e., 3.3 denier per filament/39,000 total denier from Eastman Chemical Products, Inc.) dissolved in 10 parts acetone is applied uniformly to the polyester web, and the resulting coated web is dried. The dry coating weighs 2.7 lb/3000 $ft^2$, and the cellulose acetate coating provides about 12.4 percent of the weight of the coated web, based on the original weight of the polyester web. Filter elements then are provided essentially as described in Example 1.

EXAMPLE 5

Cigarettes are provided generally as described in Example 3. However, the coated polyester web filter segment has a length of 8 mm and the cellulose acetate tow filter segment has a length of 19 mm. In addition, filter segment having the polyester web coated with polyvinyl alcohol is contacted with a solution of 1 part menthol, 2 parts propylene glycol and 2 parts ethanol by injecting that solution into the filter segment using a hypodermic needle. The cigarettes are air diluted as described in Example 1, but to a level of about 20 percent air dilution. About 0.24 mg menthol is so incorporated into each cigarette.

The cigarettes are smoked and provide for very efficient transfer of menthol of greater than 50 percent into the mainstream smoke. The cigarettes provide much more menthol flavor than is expected for a cigarette having such a relatively low level of menthol.

EXAMPLE 6

Cigarettes are provided generally as described in Example 3. However, a dispersion of ethylene/vinyl alcohol polymer in water/alcohol is applied uniformly to the polyester web, and the resulting coated web is dried. The dispersion is available as MICA G-894 from Mica Corporation. The dry coating weighs 5.2 lb./3000 $ft^2$. and that dry polymer coating provides about 24 percent of the weight of the coated web, based on the original weight of the polyester web.

EXAMPLE 7

Cigarettes are provided generally as described in Example 3. However, a solution of 1.5 Myvatem 30 from Eastman Chemical Products, Inc. in 30 parts water is applied uniformly to the polyester web, and the resulting coated web is dried. The dry coating weight 4.1 lb./3000 ft. and the coating provides about 20.6 percent of the weight of the coated web, based on the original weight of the polyester web. Filter elements then are provided essentially as described in Example 1; however, the filter elements and the resulting cigarettes are not air diluted.

EXAMPLE 8

Cigarettes substantially as shown in FIG. 2 are prepared as follows:

The cigarettes have a length of about 84 mm and a circumference of about 24.8 mm, and include a smokable rod having a length of about 64 mm and a filter element having a length of about 20 mm. Each smokable rod comprises a charge of smokable material circumscribed by a single layer of paper wrapper. Each filter element includes two segments. The first filter segment is positioned adjacent the smokable rod. The second segment includes cellulose acetate tow (3.3 denier per filament/39,000 total denier) plasticized with triacetin and circumscribed by non-porous paper plug wrap. The second filter segment has a length of 8 mm, and is positioned the first filter segment. Each filter element is attached to each tobacco rod using non-porous tipping paper. For each cigarette, the tipping paper circumscribes the filter element and a 4 mm length of the tobacco rod in the region adjacent the filter element. The cigarettes are not air diluted.

The filter material of the firs filter segment is a continuous non-woven sheet-like web available as 4TD from Eastman Chemical Co. The web includes polyester fibers available as 4SW from Eastman Chemical Company. The web has a basis weight of about 1.0 oz/$yd^2$, and a width of about 9.25 inches. The web has about 0.3 percent mineral oil applied thereto.

The filter material of the first filter segment is treated with a solution as follows: A dispersion available as MICA G-894 from Mica Corporation is provided. The dispersion is uniformly applied to the surface of the polyester fiber web using an 85 Quad gravure cylinder on a Faustel Laminator. The resulting coated web is dried convectively using air heated at about 170° F. The dry coated web includes a single pass coating of about 3.7 lb/3000 sq. ft., and includes about 24 percent copolymer in intimate contact with the polyester fiber web, based on the original weight of the polyester web. The first filter segment is provided by subdividing a rod provided by gathering the continuous web from a bobbin. The apparatus is similar to that rod making apparatus described in Example 1 of U.S. Pat. No. 4,870,809 to Pryor et al, and includes a constriction member (i.e., tongue) fashioned so that a continuous supply of water is applied to the web-contacting surface of the tongue. See, U.S. patent application Ser. No. 585,444, filed Sep. 20, 1990. Each 12 mm filter segment so provided includes a circumscribing non-porous paper plug wrap. Then, 15 ul of a solution of 1 part Myverol 18-06 from Eastman Chemical Products, Inc. in 99 parts water is injected into that filter segment.

The paper wrapper of the smokable rod comprises flax and calcium carbonate. The paper wrapper is available as Reference No. 719 from Kimberly-Clark Corp.

The smokable material is a blend of volume expanded flue-cured and Burley tobacco laminae, flue-cured tobacco laminae, Burley tobacco laminae, reconstituted tobacco and Oriental tobacco laminae. The smokable material is in the form of laminae cut into strands. The volume expanded tobacco is tobacco laminae which is cut into cut filler form and which has been expanded. The nicotine content of the blend is about 2.1 percent.

The blend of smokable materials is cased and top dressed with humectants and flavor and is provided so as to have total moisture content of about 12 percent.

The cigarettes then are employed by burning the smokable rod such that the blend of smokable material within the paper wrapper burns to yield smoke. The cigarette yields a smooth, satisfying, rounded smoking character having good tobacco smoke taste.

EXAMPLE 9

Cigarettes are provided generally as described in Example 8. However, a solution of 1 part cellulose acetate in 10 parts acetone is coated onto the polyester web, in much the same manner as described in Example 4. Then, 15 ul of a solution of 1 part propylene glycol alginate available as Kelcoloid HVF from Kelco Div. of Merck & Co. is injected into the first filter segment using a needle syringe.

EXAMPLE 10

Cigarettes are provided generally as described in Example 8. However, the polyester web is gathered to form a filter element, and is not coated with a polymeric material. Then, 15 l of a solution of 1 part Kelcoloid HVF in 99 parts water is injected into the gathered polyester web filter segment using a needle syringe. Thus, the propylene glycol alginate provides about 0.02 percent of the weight of the dried and conditioned coated web, based on the original weight of the polyester web.

EXAMPLE 11

Cigarettes are provided generally as described in Example 10. However, the polyester web is injected with 15 1 a solution of 0.1 part Nutricol GP 120 F konjac flour from FMC in 99 parts water. Thus, the konjac flour provides about 0.002 percent of the weight of the dried and conditioned coated web, based on the original weight of the polyester web.

What is claimed is:

1. A cigarette having a charge of smokable material including tobacco cut filler wrapped in a circumscribing paper wrapping material to form a smokable rod; the cigarette comprising a filter element positioned adjacent one end of the smokable rod; the filter element including a thermoplastic filter material in intimate contact with polyethylene glycol in an amount of at least about 0.001 percent, based on the weight of the filter material, the polyethylene glycol having a molecular weight above about 400, and with an acidic material having a $pK_a$ at 25° C. of less than about 3, wherein the acidic material includes phosphoric acid.

2. The cigarette of claim 1, wherein the filter material comprises polyester fibers.

3. The cigarette of claim 1, wherein the polyethylene glycol in intimate contact with the thermoplastic filter material is in an amount of at least about 10 percent, based on the weight of the filter material.

4. The cigarette of claim 1, wherein the polyethylene glycol in intimate contact with the thermoplastic filter material is in an amount of at least about 15 percent, based on the weight of the filter material.

5. The cigarette of claim 1 or 3, wherein the polyethylene glycol in intimate contact with the thermoplastic filter material is in an amount of less than about 35 percent, based on the weight of the filter material.

6. The cigarette of claim 1, having between about 5 percent to about 35 percent of polyethylene glycol based on the weight of the filter material.

7. The cigarette of claim 1, wherein the filter material in intimate contact with the acidic material comprises more than about 0.1 percent acidic material based on the dry weight of the filter material.

* * * * *

UNITED STATES PATENT AND TRADEMARK OFFICE

CERTIFICATE OF CORRECTION

PATENT NO. : 5,465,739

DATED : November 14, 1995

INVENTOR(S) : Thomas A. Perfetti et al.

It is certified that error appears in the above-indentified patent and that said Letters Patent is hereby corrected as shown below:

Col. 11, Line 12, after "factors such as the type" insert -- of tobacco material which is extracted, the extraction solvent and the type of extraction conditions. Although the nicotine contents of such extracts can very, preferred tobacco extracts have nicotine contents of less than about 50 percent, usually of less than about 25 percent, and frequently less than about 15 percent, based on the dry weight of the extract. Such preferred tobacco extracts have relatively high contents of many of the flavorful components of tobacco. Representative methods for preparing and processing tobacco extracts are set forth in European Patent Application Nos. 326,370 and 338,831, which are incorporated herein by reference. Other tobacco extracts are those extracts which are subjected to heat treatment, such as those tobacco extracts set forth in U.S. Patent No. 5,060,669 to White et al., which is incorporated herein by reference.

Typically the tobacco extract is provided within a liquid, applying the liquid and extract to a web or sheet of the coated filter material using a rotogravure or size press technique, and removing the liquid from the web or sheet. If desired, the tobacco extract can be provided within a liquid carrier, and then sprayed onto the filter material. The optional tobacco extract can be contacted with the filter material before, while, or after, the acidic material or basic material is contacted with the filter material. The tobacco extract can be a spray dried extract, a freeze dried extract or a tobacco essence which is in turn dissolved or otherwise dispersed in water or other liquid carrier in order to be applied to the filter material. Typically, the tobacco extract which optionally is in intimate contact with the filter material has a moisture content of about 5 or about 6 weight percent, although the moisture content of a particular tobacco extract can vary. --.

UNITED STATES PATENT AND TRADEMARK OFFICE

CERTIFICATE OF CORRECTION

PATENT NO. : 5,465,739

DATED : November 14, 1995

INVENTOR(S) : Thomas A. Perfetti et al.

It is certified that error appears in the above-indentified patent and that said Letters Patent is hereby corrected as shown below:

Col. 11, Line 44, after "about 5 percent, based on the" delete "of tobacco material which is extracted, the extraction solvent and the type of extraction conditions. Although the nicotine contents of such extracts can very, preferred tobacco extracts have nicotine contents of less than about 50 percent, usually of less than about 25 percent, and frequently less than about 15 percent, based on the dry weight of the extract. Such preferred tobacco extracts have relatively high contents of many of the flavorful components of tobacco. Representative methods for preparing and processing tobacco extracts are set forth in European Patent Application Nos. 326,370 and 338,831, which are incorporated herein by reference. Other tobacco extracts are those extracts which are subjected to heat treatment, such as those tobacco extracts set forth in U.S. Patent No. 5,060,669 to White et al., which is incorporated herein by reference.

Typically the tobacco extract is provided within a liquid, applying the liquid and extract to a web or sheet of the coated filter material using a rotogravure or size press technique, and removing the liquid from the web or sheet. If desired, the tobacco extract can be provided within a liquid carrier, and then sprayed onto the filter material. The optional tobacco extract can be contacted with the filter material before, while, or after, the acidic material or basic material is contacted with the filter material. The tobacco extract can be a spray dried extract, a freeze dried extract or a tobacco essence which is in turn dissolved or otherwise dispersed in water or other liquid carrier in order to be applied to the filter material. Typically, the tobacco extract which optionally is in intimate contact with the filter material has a moisture content of about 5 or about 6 weight percent, although the moisture content of a particular tobacco extract can vary."

Col. 20, Line 16, after "and is positioned" insert -- adjacent --.

Signed and Sealed this

Seventeenth Day of June, 1997

Bruce Lehman

*Attest:*

BRUCE LEHMAN

*Attesting Officer*

*Commissioner of Patents and Trademarks*